United States Patent [19]

Villa-Real

[11] 4,405,045

[45] Sep. 20, 1983

[54] AUTOMATIC TWO-COMPONENT MEDICATION TIME-INTERVAL REMINDER CAP AND CONTAINER

[76] Inventor: Antony-Euclid C. Villa-Real, 2512 Capistrano Ave., Las Vegas, Nev. 89121

[21] Appl. No.: 259,664

[22] Filed: May 1, 1981

[51] Int. Cl.[3] ..... B65D 83/04

[52] U.S. Cl. ..... 206/534; 206/459; 215/317

[58] Field of Search ..... 116/308, 309, 317; 206/15, 334, 385, 459, 534, 534.1, 534.2, 535, 536, 528, 530, 540; 215/204, 205, 221, 224, 230, 317, 321; 220/66, 69, 288, 319

[56] References Cited

U.S. PATENT DOCUMENTS

| | | | |
|---|---|---|---|
| 2,767,680 | 10/1956 | Lermer | 116/308 |
| 3,010,570 | 11/1961 | Sundstrom | 206/535 |
| 3,071,271 | 1/1963 | Thomas | 215/224 |
| 3,151,599 | 10/1964 | Livingston | 116/308 |
| 3,275,180 | 9/1966 | Optner et al. | 206/459 |
| 3,367,484 | 2/1968 | Nelson | 206/459 |
| 3,447,709 | 6/1969 | Marasco | 215/206 |
| 3,627,160 | 12/1971 | Horvath | 215/224 |
| 3,696,957 | 10/1972 | van Baarn | 215/321 |
| 3,766,882 | 10/1973 | Babbitt | 116/308 |
| 3,871,662 | 3/1975 | Hepp et al. | 215/224 |
| 3,960,173 | 6/1975 | Carey | 206/459 |
| 4,094,408 | 6/1978 | Ford | 206/534 |
| 4,127,190 | 11/1978 | Sunnen | 206/535 |
| 4,238,033 | 12/1980 | Artzt | 206/534 |

*Primary Examiner*—Joseph Man-Fu Moy
*Assistant Examiner*—David Fides
*Attorney, Agent, or Firm*—Sughrue, Mion, Zinn, Macpeak and Seas

[57] ABSTRACT

A color-coded two-component medicament container comprising a cap means with variously pre-set structural interval spacings between each pair of pre-formed window system to differentiate a fixed 3-hour time interval cap from a 4-hour time interval cap, a 6-hour time interval cap, an 8-hour time interval cap and from a unitary pre-formed window for a 12 or 24-hour time interval cap; each kind of cap to be specifically used according to the prescribed frequency of drug administration such as every 3-hour-frequency, every 4-hour-frequency, every 6-hour-frequency, every 8-hour-frequency and every 12 or 24-hour-frequency, respectively as coordinated in a snug-fitting but clockwisely rotatable engagement with a complementarily shaped cylindrical medicament container having clock-like numeral indicia ranging from 1 to 12 and equidistantly arranged as in a clock therearound the upper circumferential exterior wall of the said medicament container is disclosed.

9 Claims, 7 Drawing Figures

AUTOMATIC TWO-COMPONENT MEDICATION TIME-INTERVAL REMINDER CAP AND CONTAINER

BACKGROUND OF THE INVENTION

In the pharmacological treatment of one or more patients prescribed with a singular or a plurality of variously timed frequency of drug intake, there have been a multitude of confusions, negligences and errors committed on a worldwide scale by the patients themselves, the medical personnel and those at home taking care of the patients thus resulting in the undesired drug under-dosage as well as over-dosage that clinically affect millions of patients in an adverse manner. The reason behind these unwanted occurrences is largely because of the lack of available, simple, economical, systematic and easy to use medicament container with built-in means of properly correlating not only the time of the last dose of drug intake and the time of the next dose of drug intake but also the instant recognition of the variously pre-set time-interval between the last and the next times of drug administration specific to the medication involved. The present invention provides the solution to these problems.

Earlier attempts have been made in U.S. Pat. No. 2,706,464 awarded to H. D. North, in U.S. Pat. No. 3,960,713 awarded to Helen L. Carey, in U.S. Pat. No. 2,111,637 awarded to W. T. Mehaffey, in U.S. Pat. No. 2,450,949 awarded to S. Gattuccio et al, in U.S. Pat. No. 2,767,680 awarded to H. B. Lermer, in U.S. Pat. No. 535,610 awarded to W. H. Blaney, in U.S. Pat. No. 557,616 awarded to H. P. Scott, in U.S. Pat. No. 623,171 awarded to J. B. Mowry, in U.S. Pat. No. 3,968,900 awarded to Berigoj K. Stambuk. However, these inventions are structurally different and are either complicated, harder to manipulate, difficult to mass produce economically or lacking in other essential elements which the present invention effectively solves. None of the earlier inventions mentioned have pre-set structural spacings, color-codings and indicia differentiations depending upon the prescribed frequency of the various time-intervals of drug intake desired that can offer greater advantages and more expansive worldwide acceptability which the present invention inherently possesses.

SUMMARY OF THE INVENTION

One object of the present invention is to provide a two-component systematic device for timing and reminding the last dose of drug intake and the next dose of drug intake while affording containment of prescribed medication of certain specific frequency of drug administration.

Another object of the instant invention is to provide a medicament cap having a built-in window system for indicating both the time of the last dose of drug intake and the time of the next dose of drug intake as well as the time interval therebetween.

Still another object of the present invention is to provide a medicament container having pre-printed equally spaced numerals ranging from 1 to 12 therearound the upper circumferential area of the said medicament container below its upper open end for orientation with the built-in window system of the cap means attached therearound in order to enable the user to set the exact time of the last dose of drug intake and the next dose of drug intake.

And yet a further object of the present invention is to provide a cap means having pre-set variations of each pair of window system to differentiate a 3-hour pre-set time interval cap from a 4-hour pre-set time interval cap, a 6-hour pre-set time interval cap, an 8-hour pre-set time interval cap and a 12 or 24-hour pre-set time interval cap for better automatic efficiency in the administration of the variously needed differential frequency of drug administration such as every 3-hours, every 4-hours, every 6-hours, every 8-hours and every 12 or 24-hours, respectively.

A still further object of the present invention is to provide a container having a pair of parallel running circumferential structural ridges therearound the upper section of the outer wall of the medicament container to match with a pair of complementarily shaped circumferentially running parallel grooves therearound the inner wall of the cap to attain a snug-fitting but rotatory engagement between each other.

And yet another object of the present invention is to provide a pair of oppositely positioned protuberance at the outer border of the cap means for easier clockwise rotatory manipulation of the user during the process of setting the progressive times of the last dose and the next dose of drug administration.

And still a further object of the present invention is to provide a cap means that is not transparent with window or windows that are structural cut-outs at the side of the said cap so as to make the corresponding numerals of the clock-like numeral indicia appear in relation with the called for time of the last dose and the time of the next dose.

And yet a further object of the present invention is to provide a cap means that is transparent but with printed window-like encirclement combination having pre-set distances between each other depending upon the frequency of drug intake called for in certain specific medication, said window-like encirclement being provided first for the last dose of drug administration and second for the next dose of drug intake.

BRIEF DESCRIPTION OF ILLUSTRATIVE DRAWINGS

DETAILED DESCRIPTIONS OF THE DRAWINGS

Figure 1:
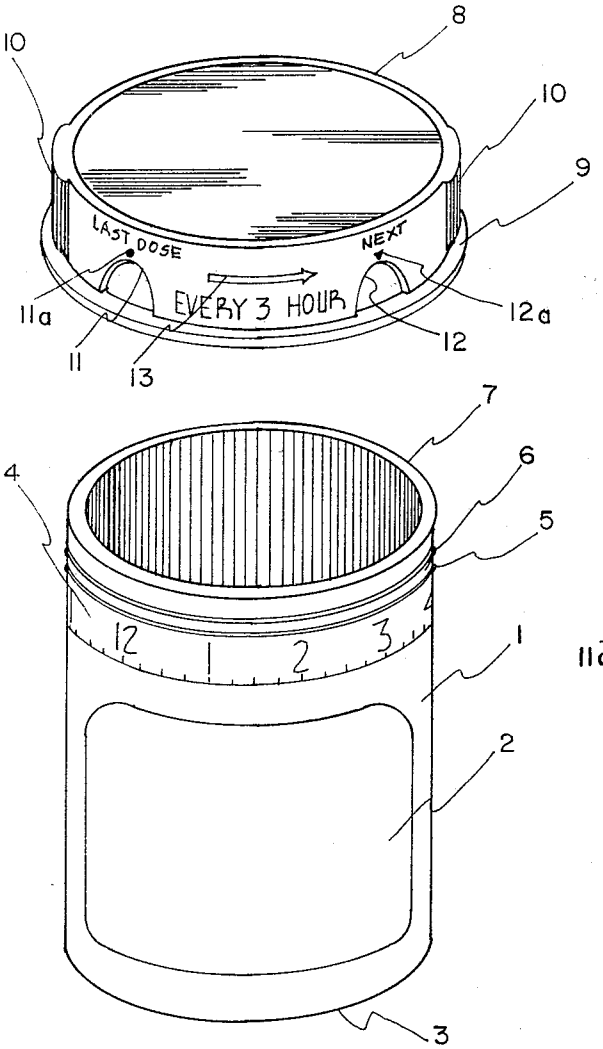
FIG. 1 is a perspective side-and-top elevational view combination of one preferred embodiment of the present invention wherein the cap is shown to be disengaged from the medicament container.
Figure 2:
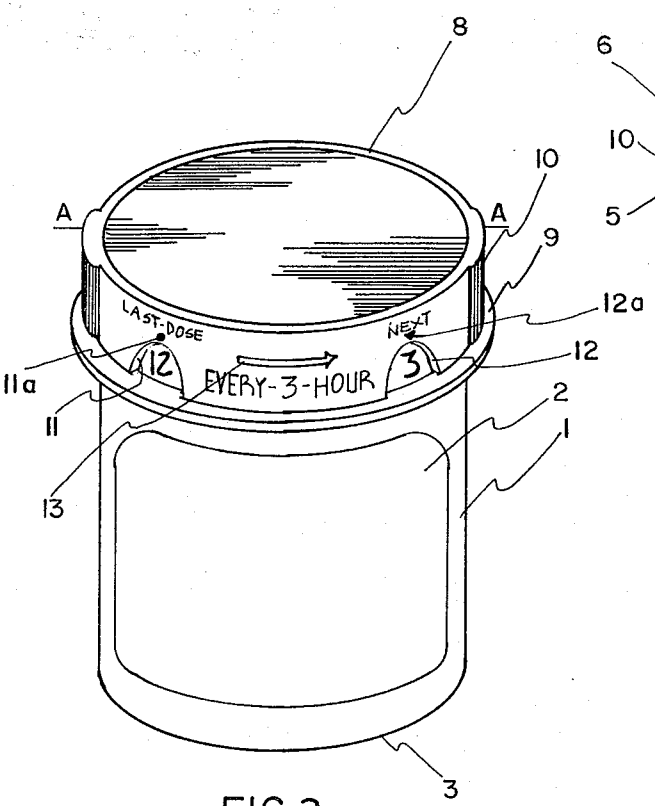
FIG. 2 is a perspective side-and-top elevational view combination of FIG. 1 but this time the cap which is a 3-hour time interval cap reminder and timer is now in the proper engaging relationship with the same medicament container of FIG. 1.
Figure 3:
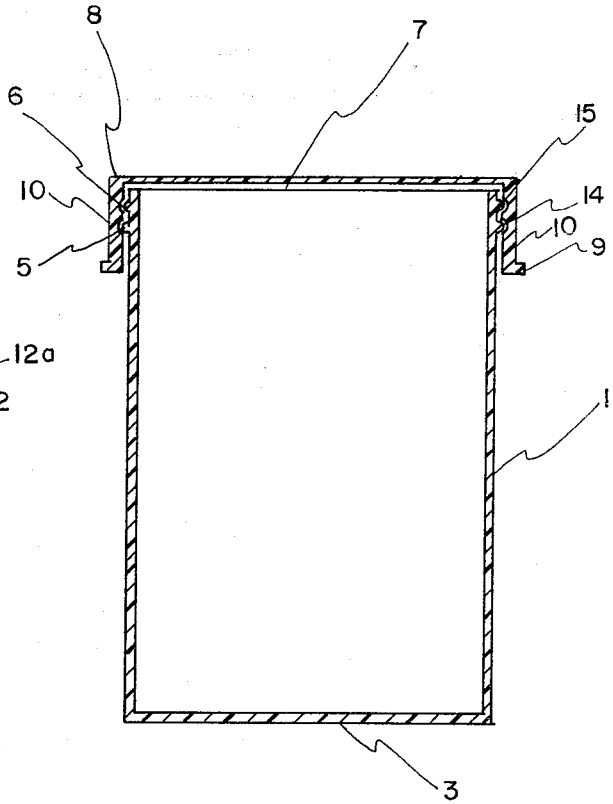
FIG. 3 is the longitudinal sectional view of the device of FIG. 1 taken at line A—A.

In the drawings wherein like letters and like numerals refer to like parts, there is shown at FIGS. 1, 2 and 3 a medicament container 1 having a closed bottom 3 and an open upper end 7, a medicament cap 8 which attaches and covers 7 and which can be detachable therefrom, and a circumferentially running tab portion 9 of the cap for the easier detachment of the same cap from its covering relationshp with the medicament container, a pair of oppositely positioned protuberance 10 at the outer portion of the cap, said protuberance having rib-like serrations to aid in the easier turning of the cap in a clockwise or rightwise manner.

At FIGS. 1 and 2, the prescription information area 2 is shown. The imprinted clock-like consecutive numerals ranging from 1 to 12 which are equally spaced between each other are printed therearound the upper circumferential area 4 just below the open end of the container. Between each of the succeeding numerals which represent the hours as in a clock are found equidistantly spaced lines which subdivide the distance between the succeeding hours into 4 spaces to represent a graduation of every 15 minutes.

At FIG. 1, just below and parallel to the open end of the container is a pair of parallel circumferentially running ridges 5 and 6 which are clearly shown to be complementarily shaped in relation to the respective complementarily shaped grooves 14 and 15 shown at FIG. 3; said grooves that are parallel to each other, are preformed circumferentially running grooves therearound the inner wall of the cap 8. The engagement relationship between the pair of respective ridges 5 and 6, and the pair of respective grooves 14 and 15 is of a snug-fitting but rotatory type of engagement inherent in resilient plastic material of which both the cap and the container are made.

At FIG. 1 there is shown a special cap with the imprint of "EVERY 3-HOURS" which is to be used for the timing and reminding of prescription medicines having a frequency of dosage intake of every 3-hours. When this cap is engaged in the covering position with the container as shown at FIG. 2, the pair of windows 11 and 12 has a 3-hour clockwise structural distance in orientation with the clock-like spacings of the numerals and their corresponding subdivisions of the clock-like indicia at area 4. The dot-like central marking **11*a* on top of window 11 helps to indicate the last time of drug dose intake in orientation with the clock-like indicia; the central arrow-like marking 12*a* is imprinted above the second window at the right side of the cap to indicate the "NEXT" time of the next dose of drug intake. In this 3-hour interval cap, the structural distance between the pair of windows is a pre-set spacing of a quarter of a circumference, so that when the time of the last dose of drug intake appears as 12 o'clock as represented by numeral 12 appearing in the first window for the last dose, the numeral 3 appears in the second window representing the time of 3 o'clock to indicate the next time of drug dose intake. The rightwardly swinging arrow 13 imprinted at the exterior wall of the cap of FIGS. 1 and 2 indicates the rightward direction of rotatory manipulation to be made by the user to properly utilize this special cap in coordination with the clock-like numeral indicia imprinted at area 4** during the progression of drug intake having a frequency of every 3-hours of drug administration.

At FIG. 3 is shown the longitudinal cross-sectional view of the medicament container and the engaged cap taken at line A—A of FIG. 2. This specifically indicates the plastic composition of both the medicament container and its corresponding cap in snug-fitting but slidable relationship between the upper portion of the said medicament container through its structural ridges 5 and 6 and the corresponding grooves 14 and 15 at the interior wall cap 8. Solid line 7 represents the background of the other half of the rim of the open end of the said medicament container.

Figure 4:
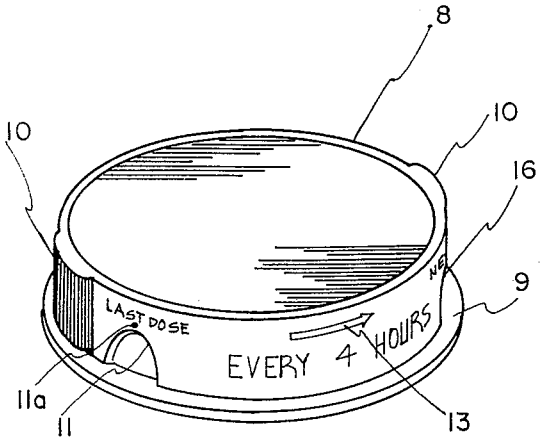
FIG. 4 is a perspective side-and-top elevational view combination of the 4-hour time interval cap reminder and timer.

At FIG. 4 we have a special cap applicable for a 4-hour frequency of prescription drug administration. Everything is comparably similar in function and structure as the cap of FIGS. 1 and 2 except that the distance between the window 11 with its dot-like marking **11*a* for the "LAST DOSE" and the window 16 for the "NEXT" dose is one-third of a circumference, so that when this cap is used in orientation with the clock-like numeral indicia at area 4 of FIG. 1**, the pre-set automatic time difference or interval between the last dose of drug-intake and the next dose of drug-intake is always set at 4-Hour interval. The other difference is the imprint of "EVERY 4-HOURS" at the exterior wall of this particular cap.

Figure 5:
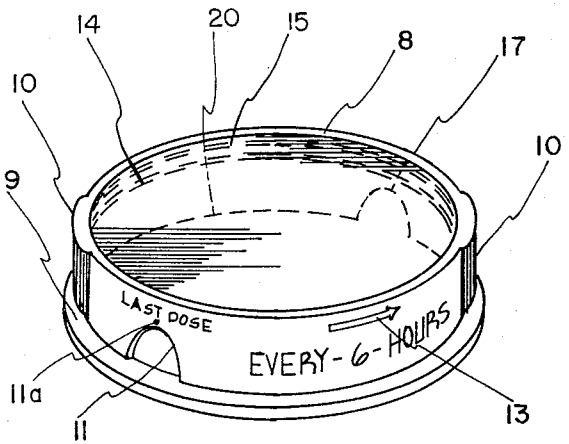
FIG. 5 is the perspective side-and-top elevational view combination of a 6-hour time interval cap reminder and timer; said view also shows the part of the hidden structures of the interior of the opposite wall of the same cap.

At FIG. 5 there is shown yet another kind of cap applicable for a 6-Hour frequency of prescription drug administration. A distance between the window 11 and its corresponding dot-like marking for the Last Dose and window 17 shown in broken lines, is a 6-Hour distance or spacing, so that when applied to the medicament container of FIG. 1 with the clock-like numeral indicia at area 4, there will always be a pre-set automatic time difference or interval of every 6-Hours between the last dose and the next dose of drug intake. Broken line 20 represent part of the internal lower rim of the circumferentially running tab 9. Broken lines 14 represents part of the circumferentially running internal lower groove of the cap, and broken lines 15 represent part of the circumferentially running upper groove of the same cap. All the other parts are similar to the caps of FIGS. 1 and 2. The imprint of "EVERY 6-HOURS" is shown at the exterior side of this particular cap.

Figure 6:
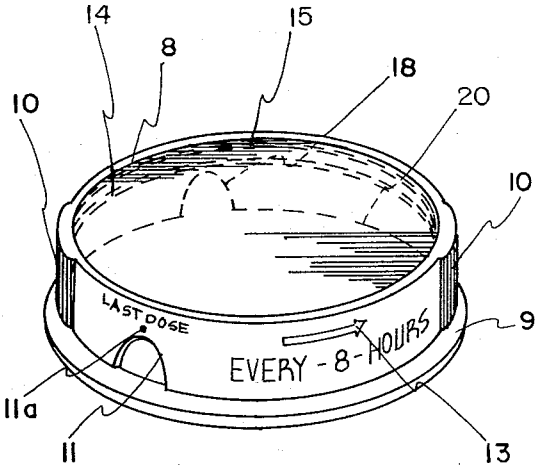
FIG. 6 is a perspective side-and-top elevational view combination of an 8-hour time interval remainder and timer; said view also shows the part of the hidden structures of the interior of the opposite wall of the same cap.

At FIG. 6 there is shown still another kind of cap applicable for an 8-Hour frequency of prescription drug administration. A distance between window 11 and its corresponding dot-like marking for the "Last Dose" and window 18 shown in broken lines is an 8-Hours spacing clockwisely or rightwardly so that when this cap is applied to the medicament container of FIG. 1 with a clock-like numeral indicia area 4, there will always be a pre-set automatic time difference or interval of every 8-hours between the last dose and the next dose drug intake. The imprint of "EVERY 8-HOURS" is shown at the exterior side of the cap. All the other structures are similar to the cap of FIGS. 1, 2, 3, 4 and 5.

Figure 7:
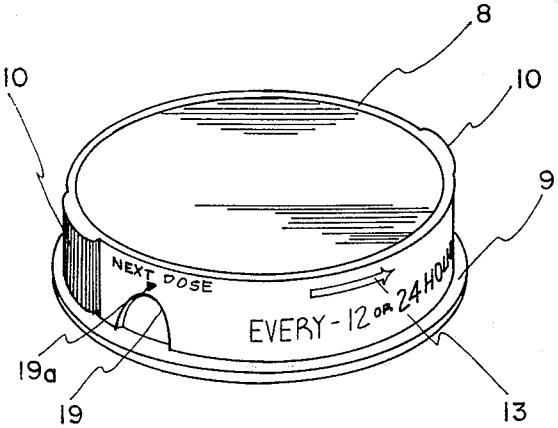
FIG. 7 is a perspective side-and-top elevational view combination of a 12 or 24-hour time interval reminder and timer.

At FIG. 7 which is a special cap applicable for a 12 or 24-hour frequency of prescription drug administration, there is only one window 19 and its corresponding arrow-like marking **19*a* for the "NEXT DOSE" of drug administration. The only requirement in the application of this particular cap is to set window 19 and its corresponding arrow-like marking 19*a* exactly aligned with the called for clock-like numeral or its subdividing line to properly coordinate with the actual time of the first drug intake, and then, utilize this fixed position to remind the user exactly the already set same time of the day or night (twice in 24 hours if the drug administration is every 12 hours) or exactly the same set time of the day or night (one every 24-hours in the administration of prescription medicines taken on a one-a-day basis). The imprint of "EVERY 12 or 24-HOURS" is found at the exterior side of this particular cap below the rightward swinging arrow 13. All the other structures are the same as in the caps of FIGS. 1, 2, 3, 4, 5 and 6**, except the ommission of the one window. All of the caps have the circumferentially running grooves found at the internal wall of each cap to correspond in snug-fitting but rotatory sliding relationship with the pair of complementarily shaped circumferentially running ridges therearound the upper portion of the medicament container.

For purposes of easier identification each of the different caps, such as the "3-Hour" interval cap, "4-Hour" interval cap, "6-Hour" interval cap, an "8-Hour" interval cap and "12 or 24-Hour" interval cap, there is a specified color-coding partly or wholly in each kind of cap.

Although in the drawings, the preferred embodiments involve medicament container caps with cut-out structural window systems to aid in the various time-interval frequency of drug administration between the time of the last dose of drug administration and the time of the next dose drug intake, wherein the rest of the cap is non-transparent and only allowing the structural cut-out windows to display the called for numerals in the clock-like area to indicate the actual time of the last dose and next dose, the variously different time-interval caps can also be made of transparent material and in place of the structural cut-out windows may be printed window-like markings for both the indication of the time of the last dose and the time of the next dose depending upon the prescribed frequency of drug administration.

The invention, as described, is susceptible to modification without departing from the inventive concept, and right is herein reserved to such modification as fall within the scope and equivalence of the appended claims.

I claim:

1. A two-component medicament container comprising:

a cylindrical hollow body closed at one end and open at the opposite end;

a pair of parallel circumferentially extending ridges on the outside circumference of the hollow body, a distance below the open end;

a plurality of hour indicia extending about the circumference of the hollow body below said ridges;

a cap for closing the open end of the hollow body having a top flat portion and a depending circular flange, the diameter of said cap being slightly larger than the diameter of said flange and ridges, a lateral flange on an end of the depending flange, a pair of parallel circumferentially extending grooves on an inside surface of the depending flange coincident with said ridges such that when said cap is telescoped over the open end of the hollow body the ridges snap into the grooves whereby the cap is tightly held onto the hollow body and rotatable thereabout, and a pair of oppositely positioned protuberances on the depending flange extending from the top flat portion to the lateral flange and having rib-like serrations thereon for facilitating gripping of the cap for ease in rotating the cap about the open end of the hollow body; and said depending flange having a plurality of semi-circular windows therein for exposing the hour indicia on the hollow body, the distance between the first window, and the second window being a quarter of a circumference from left to right to provide the cap with a pre-set-3-hour time-interval automatic time setter and reminder for use in the administration of prescribed medication having a 3-hour frequency of drug-dose intake.

2. A two-component medicament container according to claim 1 wherein:

the distance between the first window and the second window being a one third of a circumference from left to right to provide the said cap with a pre-set-4-hour time-interval automatic time setter and reminder for use in the administration of prescribed medication having a 4-hour frequency of drug-dose intake period.

3. A two-component medicament container according to claim 1 wherein:

the distance between the first window and the second window being one half of a circumference from left to right to provide the said cap with a pre-set-6-hour time-interval automatic time setter and reminder for use in the administration of prescribed medication having 6-hour frequency of drug-dose intake period.

4. A two-component medicament container according to claim 1 wherein:

the distance between the first window and the second window being 3-quarters of a circumference from left to right to provide the said cap with a pre-set-8-hour time-interval automatic time setter and reminder for use in the administration of prescribed medication having an 8-hour frequency of drug-dose intake period.

5. A two-component medicament container according to claim 1, wherein:

said cap having various drug-dose intake indicating means color-coded to differentiate each drug-dose intake.

6. A two-component medicament container according to claim 1, wherein:

circular indicia means at the apex of said semi-circular window in registry with one of said hour indicia to indicate the last does taken.

7. A two-component medicament container according to claim 1, wherein:

arrow-like indicia at the apex of an adjacent semi-circular window in registry with an hour indicia to indicate the next dose to be taken.

8. A two-component medicament container according to claim 1, and:

additional directional indicia between said semi-circular windows to indicate the direction in which to rotate said cap to align said indicia at the apex of said semi-circular windows to the next pertinent hour indicia.

9. A two-component medicament container according to claim 1, wherein:

said hollow body and said cap being constructed from plastic material and being transparent.

* * * * *